US008430798B2

(12) United States Patent
Lan et al.

(10) Patent No.: US 8,430,798 B2
(45) Date of Patent: Apr. 30, 2013

(54) COMPRESSIBLE TOY HAVING MICRO ELECTRICAL MECHANICAL SYSTEM PRESSURE SENSING MODULE

(75) Inventors: Hai Lan, Taipei Hsien (TW); Ga-Lane Chen, Santa Clara, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 410 days.

(21) Appl. No.: 12/820,062

(22) Filed: Jun. 21, 2010

(65) Prior Publication Data

US 2011/0245046 A1 Oct. 6, 2011

(30) Foreign Application Priority Data

Apr. 6, 2010 (TW) ..... 99110487 A

(51) Int. Cl.
*A63B 69/021* (2006.01)
*A63H 3/28* (2006.01)

(52) U.S. Cl.
USPC ..... 482/84; 446/300

(58) Field of Classification Search ..... 482/1–9, 482/51, 83–84
See application file for complete search history.

(56) References Cited

U.S. PATENT DOCUMENTS

| | | | | |
|---|---|---|---|---|
| 5,184,831 | A * | 2/1993 | Garner | 273/455 |
| 7,384,380 | B2 * | 6/2008 | Reinbold et al. | 482/91 |
| 7,812,418 | B2 * | 10/2010 | Hsu et al. | 257/419 |
| 8,021,281 | B2 * | 9/2011 | Forsell et al. | 482/84 |
| 8,210,994 | B2 * | 7/2012 | Chang et al. | 482/83 |
| 2005/0266967 | A1 * | 12/2005 | Considine et al. | 482/84 |
| 2005/0288119 | A1 * | 12/2005 | Wang et al. | 473/223 |
| 2009/0098795 | A1 * | 4/2009 | Wang et al. | 446/300 |
| 2010/0309209 | A1 * | 12/2010 | Hodgins et al. | 345/473 |

* cited by examiner

*Primary Examiner* — Stephen Crow
(74) *Attorney, Agent, or Firm* — Altis Law Group, Inc.

(57) ABSTRACT

A MEMS pressure sensing module is respectively applied in a boxing target and compressible toy both having an output circuit for coupling with a terminal electronic device. The MEMS pressure sensing module is configured for sensing a pressure applied thereon, converting the pressure values into electronic signals, and calculating a value of the pressure according to the electronic signals. The MEMS pressure sensing module is connected with the output circuit such that a user is able to obtain the pressure value from the terminal electronic apparatus.

6 Claims, 6 Drawing Sheets

COMPRESSIBLE TOY HAVING MICRO ELECTRICAL MECHANICAL SYSTEM PRESSURE SENSING MODULE

CROSS REFERENCE TO RELATED APPLICATION

This application is related to a commonly-assigned copending application, entitled "MOTION CONTROLLER HAVING MICRO ELECTRICAL MECHANICAL SYSTEM PRESSURE SENSING MODULE". The disclosure of the above-identified application is incorporated herein by reference.

BACKGROUND

1. Technical Field

The present disclosure relates to entertainment products, and particularly, to a boxing target and a compressible toy including a micro electrical mechanical system (MEMS) pressure sensing module.

2. Description of Related Art

In modern society, more and more people study boxing in their spare time. Unfortunately, a conventional boxing target is unable to provide an exact measurement of the force the user applies to a striking surface. As a result, the user is unable to adjust their striking force according to the impact applied to a striking target. People often strike a compressible toy for relaxation in their spare time too. However, a conventional compressible toy often can't provide an exact readout of the impact administered to a striking surface, which would give a user the knowledge and satisfaction from knowing when higher and higher levels of force are applied. Therefore, a boxing target and compressible toy capable of notifying the user of the impact of their striking force in real-time is desired.

BRIEF DESCRIPTION OF THE DRAWINGS

Many aspects of the present boxing target and compressible toy can be better understood with reference to the following drawings. The components in the drawings are not necessarily drawn to scale, the emphasis instead being placed upon clearly illustrating the principles of the present boxing target and compressible toy. Moreover, in the drawings, like reference numerals designate corresponding parts throughout the several views.

DETAILED DESCRIPTION

Embodiment of the present boxing target and compressible toy having a micro electrical mechanical system (MEMS) pressure sensing module will now be described in detail below and with reference to the drawings. The MEMS is an integrated micro system including a micro sensor, a processor, a circuit for processing and controlling signals, an interface circuit, a communicator, and a power supply.

Figure 1:
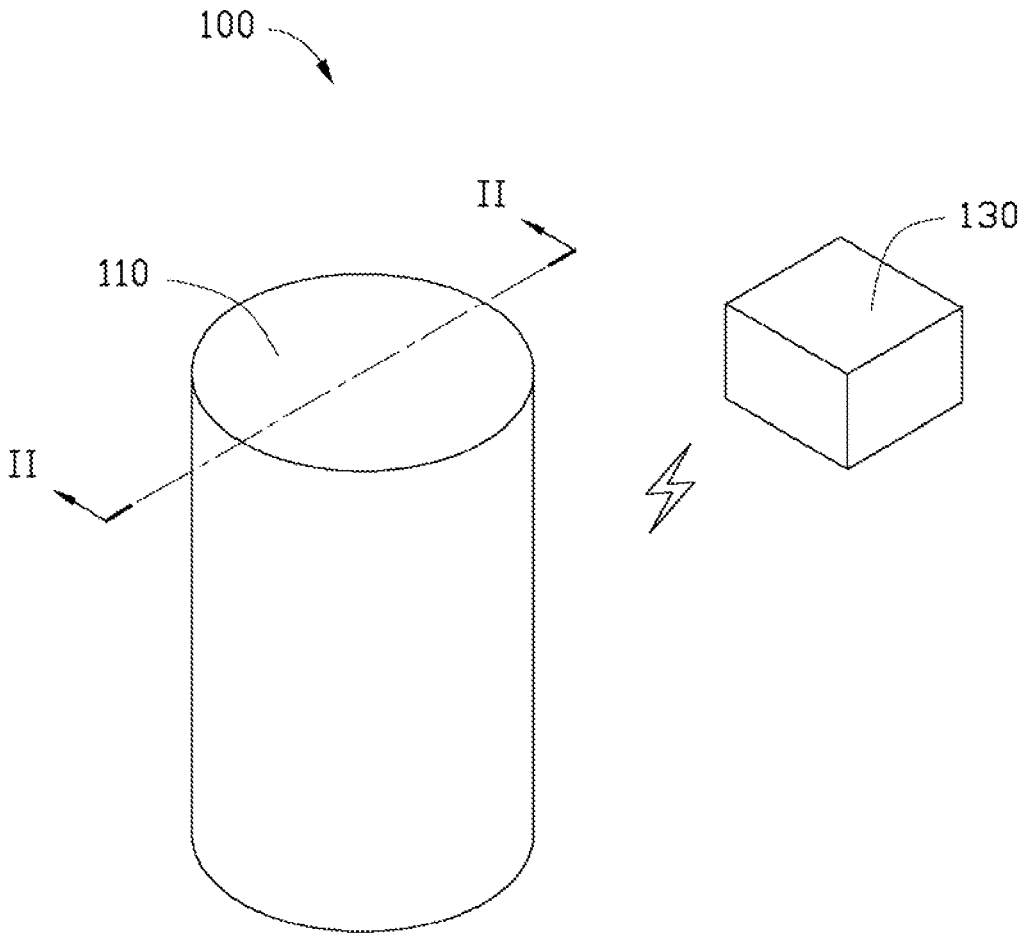
FIG. 1 is an isometric view of a boxing target in accordance with an embodiment, where the boxing target has a micro electrical mechanical system (MEMS) pressure sensing module.
Figure 2:
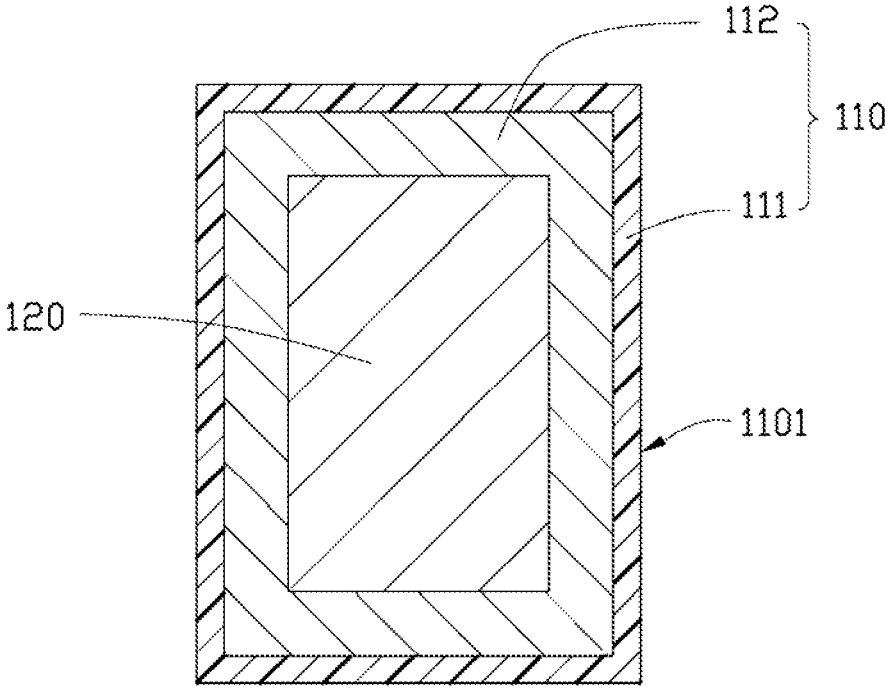
FIG. 2 is a cross section view of the boxing target of FIG. 1 taken along line II-II.
Figure 3:
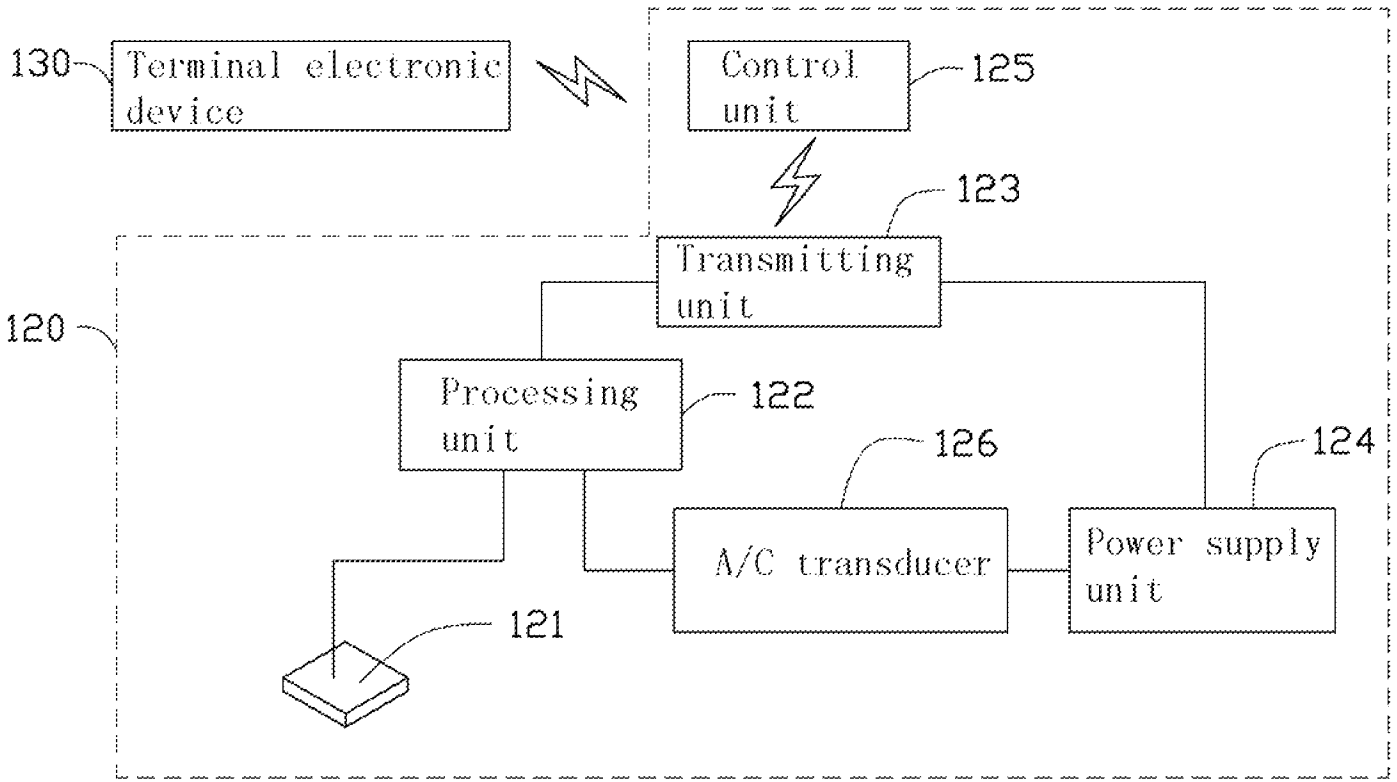
FIG. 3 is a block diagram shows a configuration of the MEMS pressure sensing module.

Referring to FIGS. 1-3, a boxing target 100 includes a cylinder-shaped target body 110, a MEMS pressure sensing module 120, and a terminal electronic device 130. The target body 110 includes a hollow cover 111 and a pressure transmitting medium 112 incorporated into the cover 111. The cover 111 has a sidewall 1101 for striking. The cover 111 and the pressure transmitting medium 112 are capable of deforming under an exterior force and then recovering to their original shape after release of force. The MEMS pressure sensing module 120 is entirely embedded within the pressure transmitting medium 112. When the sidewall 1101 is struck, the pressure is transmitted from the cover 111 to the MEMS pressure sensing module 120. In addition, the target body 110 has an output circuit (not shown) for communicating with the terminal electronic device 130, which is accommodated in the target body 110. The output circuit and the MEMS pressure sensing module 120 are integrated on a printed circuit board.

Referring to FIG. 2, the MEMS pressure sensing module 120 includes the MEMS sensor 121, a processing unit 122, a transmitting unit 123, a power supply unit 124, a control unit 125 and an A/C transducer 126 which are all integrated on the printed circuit board. The MEMS sensor 121 is entirely surrounded by the pressure transmitting medium 122, and is configured for sensing the pressure and generating an electronic signal associated with the pressure.

The processing unit 122 is electronically connected to the MEMS sensor 121, and is configured for determining the values of the pressure according to the digital signals from the MEMS sensor 121. The processing unit 122 is a micro control unit. In an alternate embodiment, the processing unit 122 is an application-specific integrated circuit.

The transmitting unit 123 is electrically connected to the processing unit 122 and the control unit 125, and is configured for transmitting the values of the pressure from the processing unit 122 to the control unit 125. In the present embodiment, the transmitting unit 123 is a BLUETOOTH unit.

The power supply unit 124 is configured for supplying power to the transmitting unit 123 and the processing unit 122. In the present embodiment, the power supply unit 124 is a battery array. The A/C transducer 126 connects with the processing unit 122 and the power supply unit 124, and is configured for converting a voltage of the power supply unit 124 into a rated voltage for the processing unit 122. In an alternate embodiment, the A/C transducer 126 may be omitted.

The control unit 125 is configured for storing the value of the pressure calculated for a current blow, drawing a diagram reflecting how the pressure varies during a period of use, and controlling an operation of the terminal electronic apparatus 130 through the output interface circuit. In the present embodiment, the terminal electronic apparatus 130 is a wireless display able to wirelessly communicate with the target body 110. In an alternate embodiment, the terminal electronic apparatus 130 may be an audio device for directly broadcasting pressure values and/or other performance results. A user may be given many choices for type of the terminal electronic apparatus to use with the target body 110.

The MEMS pressure sensing module 121 is relatively small, sensitive, and has a quick response to any pressure. Therefore, a user is able to obtain more accurate pressure readings during use of the boxing target. In this manner, a user is able to adjust their striking force and compare with previous performances. In addition, users can seek to strike the boxing target 100 with a consistent pressure during a period of use to train or test his or her endurance.

Figure 4:
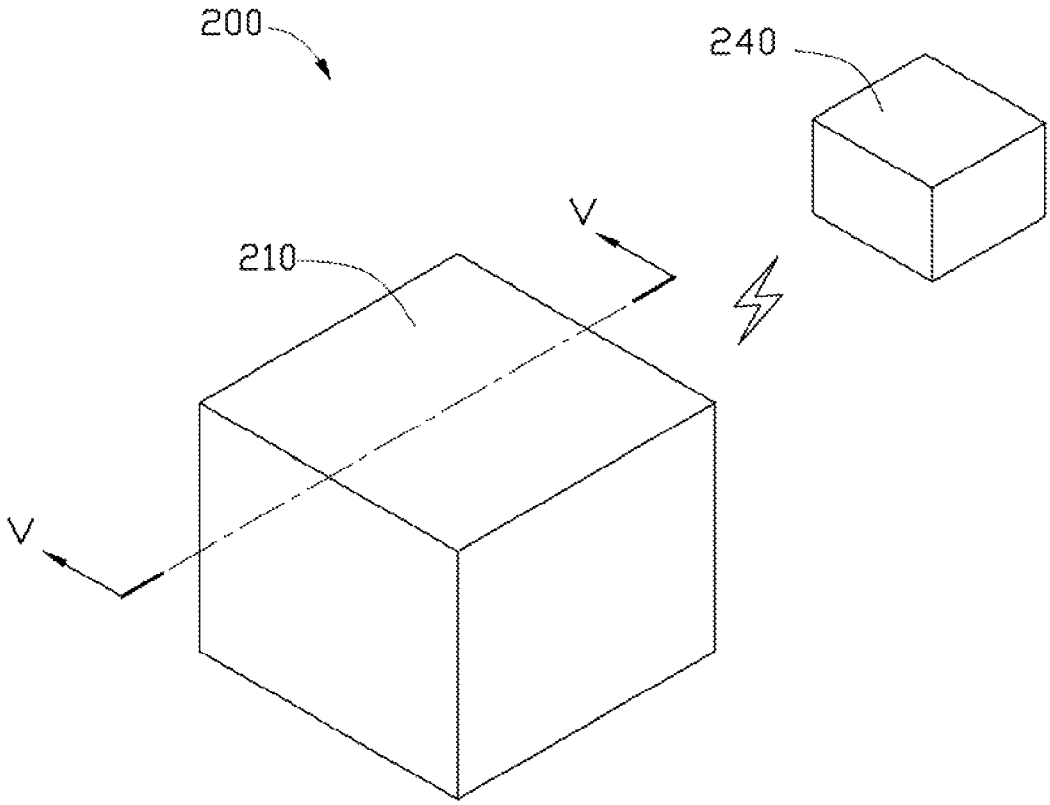
FIG. 4 is an isometric view of a compressible toy in accordance with another embodiment, which includes a MEMS pressure sensing module.
Figure 5:
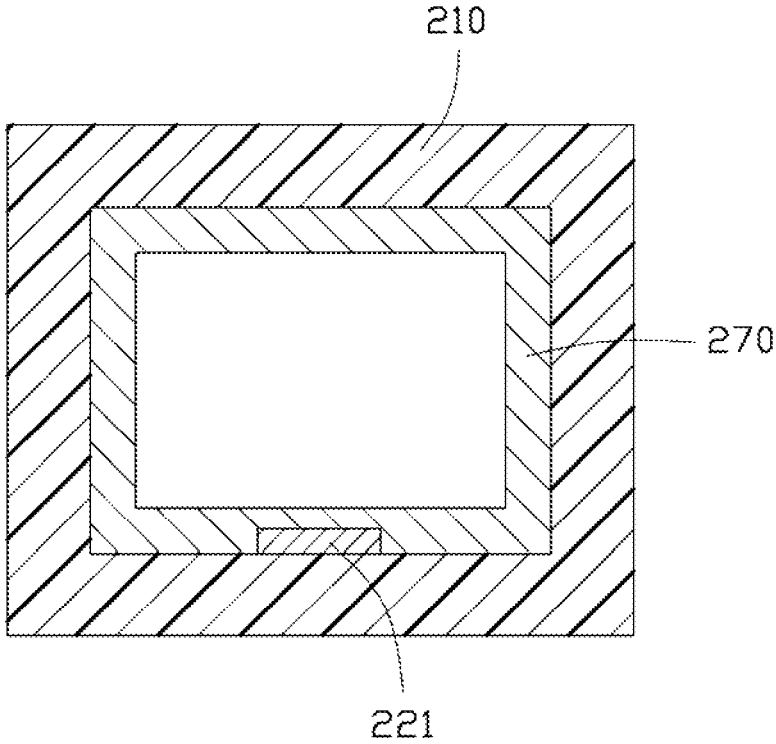
FIG. 5 is a cross section view of the compressible toy of FIG. 4 taken along line V-V.
Figure 6:
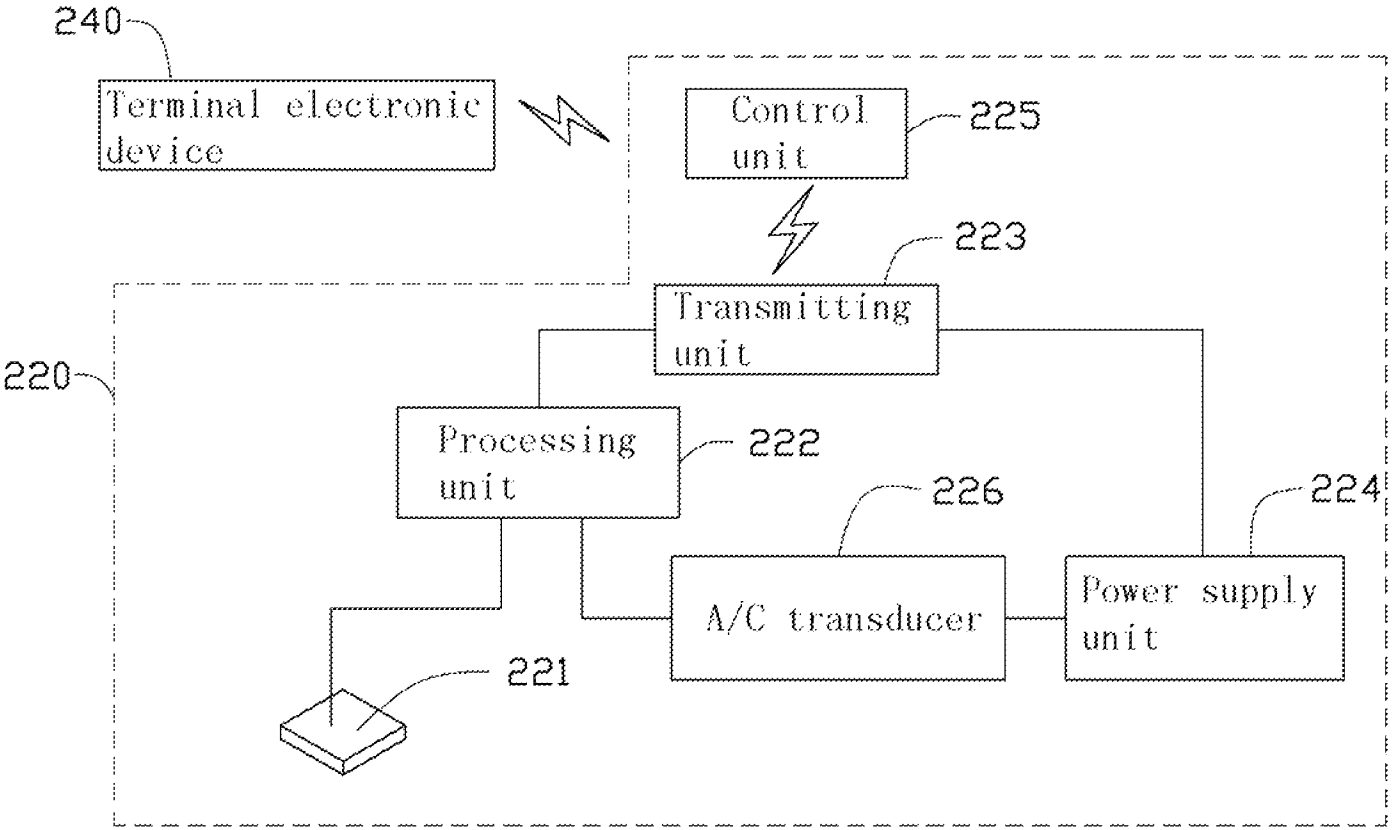
FIG. 6 is a block diagram showing a configuration of the MEMS pressure sensing module.

Referring to FIGS. 4-6, a compressible toy 200 provided in another embodiment includes a hollow shell 210, a compressible member 270, a MEMS pressure sensing module 220, and a terminal electronic device 240.

The shell 210 is capable of deforming under an exterior force and recover to its original shape upon cessation of force. The shell 210 can be made to resemble different things, such as an animal or person. The compressible member 270 and the MEMS pressure sensing module 220 are accommodated in the shell 210. The shell 210 has an output port (not shown) for communicating with the terminal electronic device 240. The output port and the MEMS pressure sensing module 220 are integrated in a printed circuit board (not shown) accommodated in the shell 210.

The compressible member 270 completely fills the shell 210. The compressible member 270 can define an opening (not shown) through which air can escape or be drawn in when the compressible member 270 is being compressed or recovering from compression.

The MEMS pressure sensing module 220 has the same configuration as the MEMS pressure sensing module 120. The MEMS pressure sensing module 220 includes a MEMS sensor 221, a processing unit 222, a transmitting unit 223, a power supply unit 224, a control unit 225 and an A/C transducer 226 which are all integrated on the printed circuit board. The MEMS sensor 221 seals the opening of the compressible member 270. When the compressible member 270 is compressed with an exterior pressure, the airflow applies an impact force equivalent to the pressure onto the MEMS sensor 221. The MEMS sensor 221 is capable of sensing the pressure according to the impact force and generating an electronic signal associated with the pressure value. In alternate embodiments, the compressible member 270 does not define the opening, and is directly disposed on a MEMS sensor 221.

The control unit 225 differs from the control unit 125 in that the control unit 225 stores predetermined values of mass and pressures, and video files and/or audio files associated with each. Once the processing unit 223 receives the values of the pressure transmitted from the control unit 225, it compares the pressure with the predetermined values, and finds the corresponding video files and or audio files.

The terminal electronic device 230 is a video device, which wirelessly communicated with the control unit 225. The terminal electronic device 230 is configured for broadcasting a video file under control of the control unit 225. In an alternate embodiment, the terminal electronic device 230 is a video device, or a device capable of broadcasting video and audio.

The MEMS pressure sensing module 221 is relatively small, sensitive, and has a quick response to any pressure. Therefore, the compressible toy is able to provide different videos and or audios so that a user will maintain their interest.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. A compressible toy, comprising:

a hollow shell;

a compressible member accommodated in and directly contacting with the shell, wherein a sealed cavity is only defined in the compressible member;

an output port exposed to an outside of the shell for coupling with a terminal electronic device; and a MEMS pressure sensing module, comprising:

a MEMS sensor arranged outside of the sealed cavity and directly contacted with the compressible member and the shell, wherein the compressible member and the shell are positioned on two sides of the MEMS sensor and opposite to each other, the MEMS sensor is configured for sensing a pressure applied on the shell and generated through the sealed cavity, and generating an electronic signal associated with the pressure;

a processing unit for determining a value of the pressure according to the electronic signal, and sending the value of the pressure to the terminal electronic device via the output port; and a power supply unit for supplying power to the processing unit.

2. The compressible toy of claim 1, wherein the terminal electronic device is configured for receiving and displaying the value of the pressure to a user.

3. The compressible toy of claim 1, wherein the MEMS pressure sensing module further comprises a transmitting unit and a control unit, the transmitting unit and the control unit electrically connected with the output port; the transmitting unit configured for transmitting the value of the pressure to the control unit, the control unit configured for storing a plurality of audio files or video files, the audio files or video files being respectively representative of a plurality of predetermined values of the pressure, the control unit configured for selecting and playing one audio file or video file according to the value of the pressure sensed by the MEMS sensor.

4. The compressible toy of claim 3, wherein the MEMS pressure sensing module further comprises an A/C transducer interconnected between the processing unit and the power supply unit.

5. The compressible toy of claim 4, further comprising a printed circuit board with the output port, the MEMS sensor, the processing unit, the power supply unit, the transmitting unit, the control unit and the A/C transducer.

6. The compressible toy of claim 3, wherein the terminal electronic device is wirelessly communicated with the control unit.

* * * * *